US005532442A

United States Patent [19]

Lin

[11] Patent Number: 5,532,442

[45] Date of Patent: Jul. 2, 1996

[54] SLIDING TYPE SWITCH ASSEMBLY

[76] Inventor: Chao-Chi Lin, No. 2, Jin-Chein 4th Street, West Dictnict, Taichung, Taiwan

[21] Appl. No.: 384,739

[22] Filed: Feb. 7, 1995

[51] Int. Cl.[6] ..... H01H 15/02

[52] U.S. Cl. ..... 200/16 C

[58] Field of Search ..... 200/16 C, 16 D, 200/537–550, 237, 275, 11 R–11 TW

[56] References Cited

U.S. PATENT DOCUMENTS

| | | | |
|---|---|---|---|
| 1,801,611 | 4/1931 | Norviel | 200/16 C |
| 2,303,693 | 12/1942 | Hill | 200/16 C X |
| 3,270,149 | 8/1966 | O'Shea et al. | 200/16 C |
| 3,646,300 | 2/1972 | Manabe | 200/16 R X |
| 4,168,405 | 9/1979 | Raab et al. | 200/16 C X |
| 4,258,237 | 3/1981 | Beck | 200/16 C X |

*Primary Examiner*—J. R. Scott
*Attorney, Agent, or Firm*—Charles E. Baxley

[57] ABSTRACT

A sliding type switch includes a non-conductive slide slidably engaged in a non-conductive housing and includes a knob extended outward of the housing for moving the slide. A non-conductive board is secured in the housing and three pairs of conductive prongs are secured to the board. The slide includes two openings for receiving two spring elements. The spring elements may be either conductive or non-conductive. Each of the spring elements engages a conductor and moves in concert therewith. The spring elements are provided with S-shaped springs each having two curved tips to bias the conductors to engage electrically with two pairs of the three pairs of conductive prongs.

1 Claim, 3 Drawing Sheets

SLIDING TYPE SWITCH ASSEMBLY

BACKGROUND OF THE INVENTION

1. Field of the Invention

The present invention relates to a switch, and more particularly to a sliding type switch assembly.

2. Description of the Prior Art

Typical switches comprise generally two types including a press type having a button depressed for actuating the switches and a switch type including a switch button movable for actuating the switches.

The present invention has arisen to provide a novel switch having a slidable knob for actuating the switches.

SUMMARY OF THE INVENTION

The primary objective of the present invention is to provide a sliding type switch having a knob for moving and actuating the switches.

In accordance with one aspect of the invention, there is provided a sliding type switch comprising a non-conductive housing including a hollow interior having an upper portion, and including a lower portion having a slot formed therein, a non-conductive board secured in the upper portion of the hollow interior, three pairs of prongs secured in the board and each including a conductive base portion located within the housing, a non-conductive slide slidably engaged in the housing and including a knob slidably engaging in the slot for moving the slide within the housing, the slide defining two elongated troughs formed therein, two spring elements engaged in the openings of the slide respectively, and two first conductors engaged on the spring elements and each including two legs for engaging with the first conductors so as to be moved in concert with the first conductors. The spring elements bias the first conductors to engage electrically with two pairs of the three pairs of conductive prongs.

Two second conductors are engaged between the first conductors and the spring elements and each includes an S-shape having two curved tips for engaging with and for biasing the first conductors to engage with the prongs.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
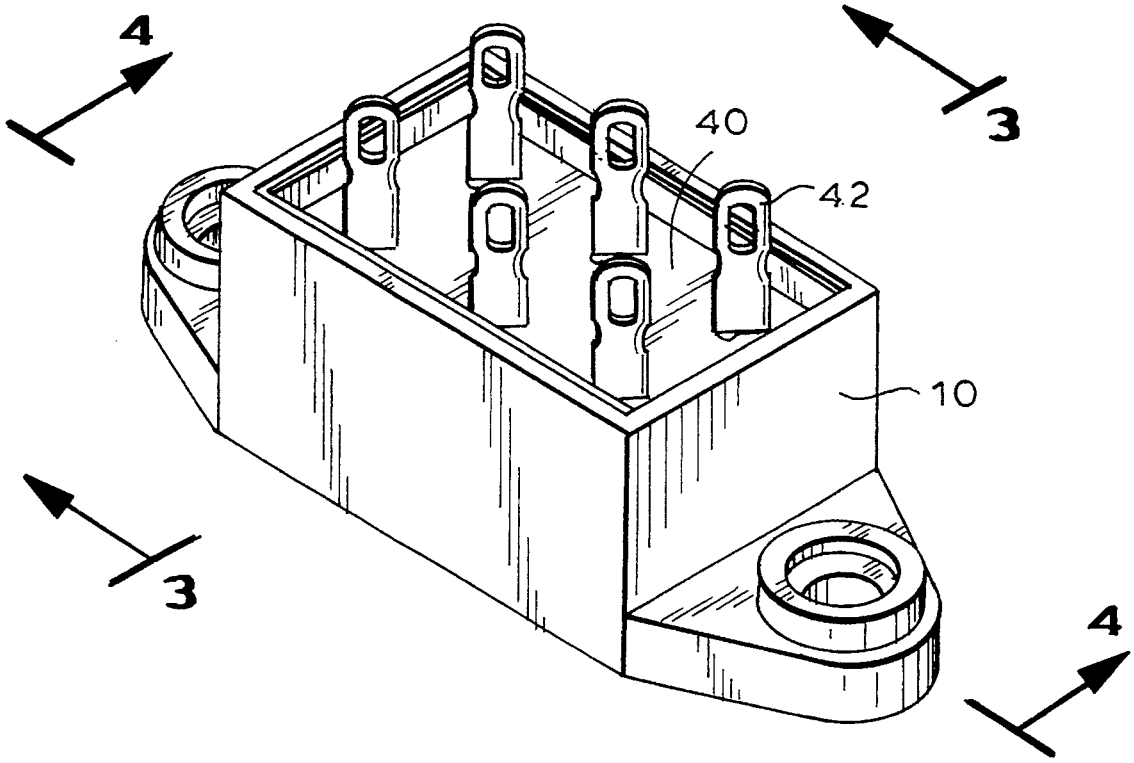
FIG. 1 is a perspective view of a switch in accordance with the present invention.

Referring to the drawings, and initially to FIGS. 1 to 4, a sliding type switch in accordance with the present invention comprises a non-conductive housing 10 having a hollow interior 11 for accommodating a non-conductive slide 20 therein and having a groove 110 formed in the inner peripheral portion thereof. The slide 20 may be fabricated from a plurality of distinct pieces structurally joined together, but it is shown for simplicity as an integral unit. The housing 10 includes a slot 101 formed in the bottom portion, best shown in FIGS. 3 and 4. A non-conductive board 40 is received in the non-conductive housing 10 and has a peripheral portion engaged in the groove 110 such that the board 40 can be secured solidly to the housing 10. The board 40 includes three pairs of apertures 41 for engaging with three pairs of conductive prongs 42. Each of the prongs 42 includes a conductive a base portion 43 formed on a bottom portion of the prong and located within the housing 10.

Figure 5:
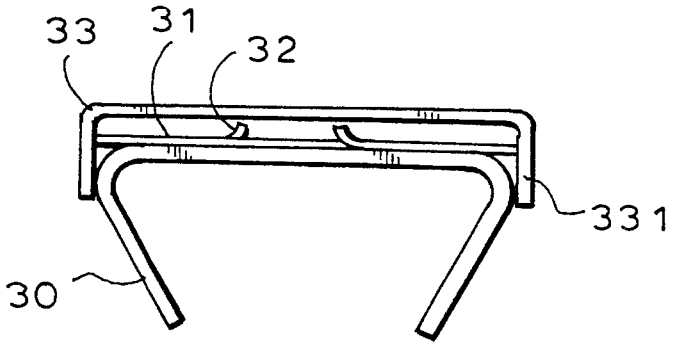
FIG. 5 is a schematic view illustrating the engagements of the electric contacts.
Figure 2:
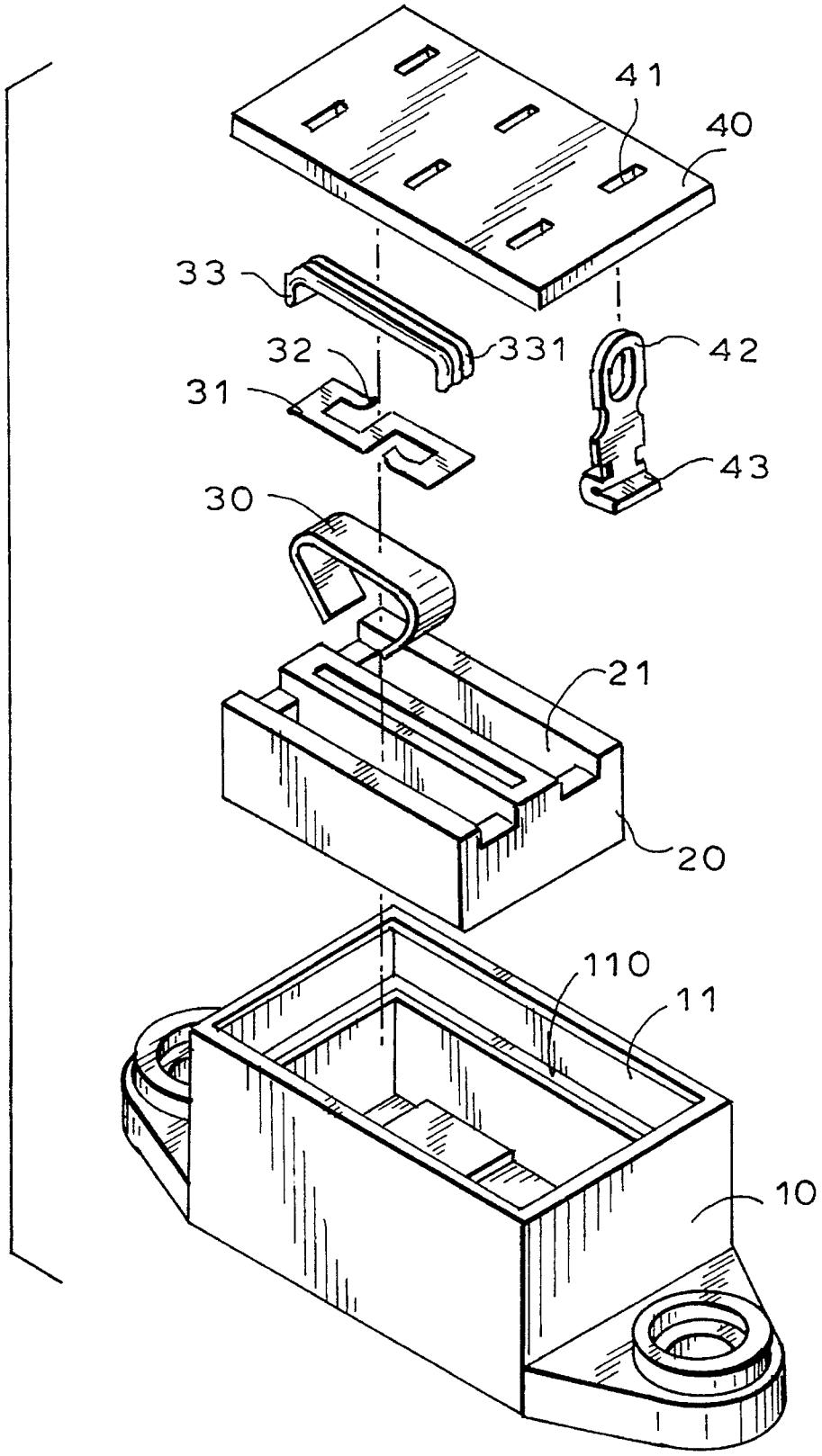
FIG. 2 is an exploded view of the switch.
Figure 3:
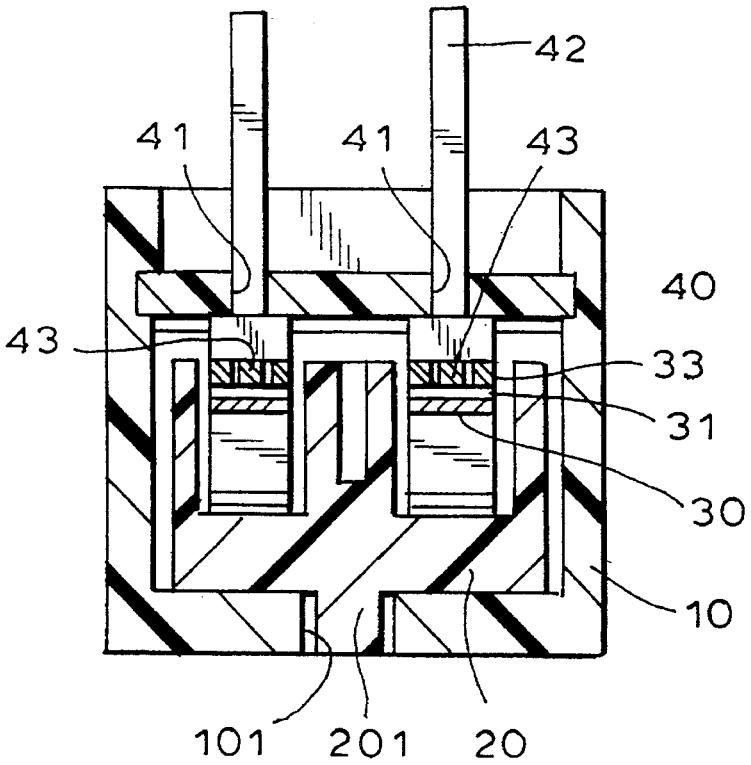
FIG. 3 is a cross sectional view taken along line 3—3 of FIG. 1.

The non-conductive slide 20 includes a knob 201 extended downward therefrom and engaging slidably in the slot 101 of the housing 10 such that the slide 20 can be moved within the housing 10 by the knob 201. The slide 20 includes two troughs 21 formed therein for each receiving respectively a spring element 30 which can be made of either conductive or non-conductive material. Each of the spring elements 30 includes an inverted U-shape. An S-shaped spring (also either conductive or non-conductive) 31 is engaged above each of the spring elements 30 and includes two tips 32 curved upwardly. An inverted U-shaped conductor 33 is engaged over the conductors 31 and is biased upwardly to electrically engage with the conductive base portions 43 of the non-conductive prongs 42 for electrically coupling two of the non-conductive prongs 42 together. The spring elements 30 and the curved upward tips 32 of the S-shaped springs 31 bias the conductors 33 upwardly to engage with the conductive base portions 43 of the conductive prongs 42, best shown in FIG. 5. Each of the conductors 33 includes two legs 331 for engaging with the springs 30 such that the conductors 33 may be moved in concert with the springs 30.

Figure 4:
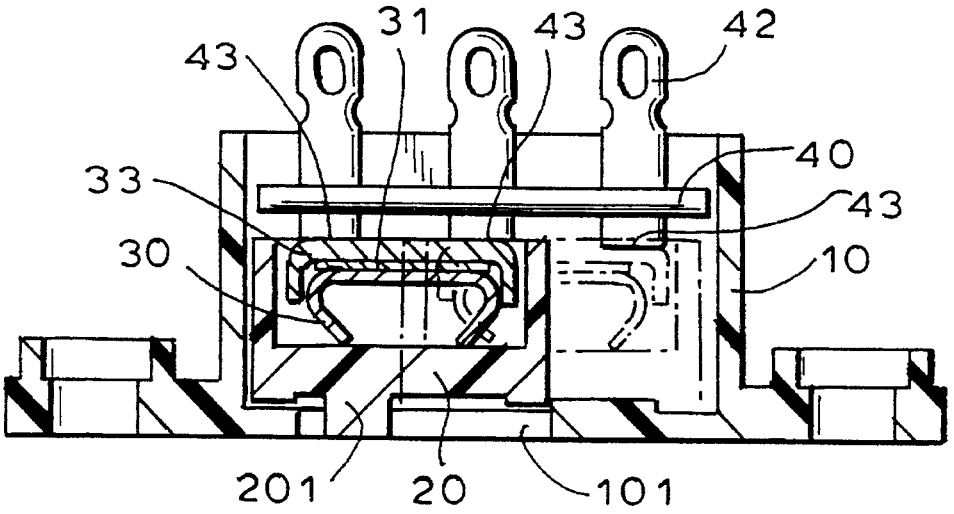
FIG. 4 is a cross sectional view taken along line 4—4 FIG. 1.

In operation, as shown in FIG. 4, when the slide 20 is moved in the housing 10 by the knob 201, two of the three pairs of the conductive prongs 42 are electrically coupled together by the conductors 33.

Accordingly, the sliding type switch of the present invention includes a novel useful and unobvious configuration.

Although this invention has been described with a certain degree of particularity, it is to be understood that the present disclosure has been made by way of example only and that numerous changes in the detailed construction and the combination and arrangement of parts may be resorted to without departing from a central spirit and scope of the invention as hereinafter claimed.

I claim:

1. A sliding type switch comprising:

a non-conductive housing enclosing a chamber and including an upper portion and a lower portion, with a slot formed in the lower portion;

a non-conductive board in the chamber and secured to the upper portion;

at least three conductive prongs secured to the board with the bottom of each of the prongs forming a conductive shoe;

a non-conductive slide member in the chamber and defining an elongated trough, the slide member connected to a knob movable slidably in the slot for selectively positioning the slide member within the chamber;

the conductive shoes aligned along the trough;

a spring element in the trough and having two projecting legs engaging with the slide member;

a conductor mounted on the spring element for conjoined movement therewith so as to engage electrically with two of the three conductive shoes;

an S-shaped spring mounted between the spring element and the conductor, the s-shaped spring having two ends each provided With a curved tip for biasing the conductor to engage with said conductive shoes.

* * * * *